United States Patent [19]

Schubert

[11] 4,253,600

[45] Mar. 3, 1981

[54] FAST FOOD CONTAINER

[75] Inventor: John C. Schubert, Chippewa Falls, Wis.

[73] Assignee: Standard Oil Company (Indiana), Chicago, Ill.

[21] Appl. No.: 902,339

[22] Filed: May 3, 1978

Related U.S. Application Data

[62] Division of Ser. No. 826,719, Aug. 22, 1977, abandoned.

[51] Int. Cl.[3] ..... B65D 43/10; B65D 1/26; B65D 5/66

[52] U.S. Cl. ..... 229/2.5 R; 229/45; 220/307; 220/367

[58] Field of Search ..... 229/2.5, 44, 45; 220/306, 307, 367

[56] References Cited

U.S. PATENT DOCUMENTS

| | | | |
|---|---|---|---|
| 2,884,155 | 4/1959 | Hanson | 229/2.5 R X |
| 3,633,785 | 1/1972 | Cyr et al. | 229/2.5 R X |
| 3,767,110 | 10/1973 | Congleton | 229/45 |
| 3,851,789 | 12/1974 | Case et al. | 220/307 |
| 3,876,130 | 4/1975 | Haase | 229/2.5 R |
| 3,935,962 | 2/1976 | Schubert et al. | 220/306 |
| 3,955,710 | 5/1976 | Commisso | 220/306 |
| 3,968,921 | 7/1976 | Jewell | 220/307 |
| 4,079,880 | 3/1978 | Edwards | 229/2.5 R X |
| 4,096,968 | 1/1978 | Floriam | 220/367 |

*Primary Examiner*—Davis T. Moorhead

*Attorney, Agent, or Firm*—Robert R. Cochran; William T. McClain; William H. Magidson

[57] ABSTRACT

Container suitable for use in fast food operations which permits longer storage of food products therein while maintaining good quality. Projections are provided on the base of the container to permit air circulation between a prepared food product and prevent deterioration thereof.

11 Claims, 8 Drawing Figures

FIG. 1
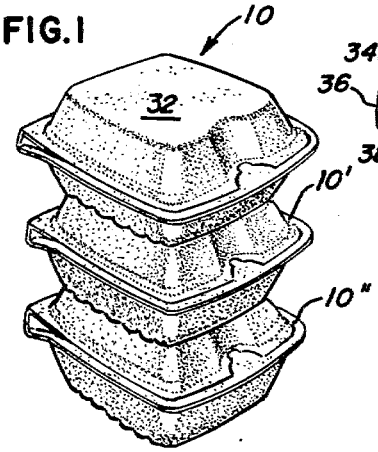
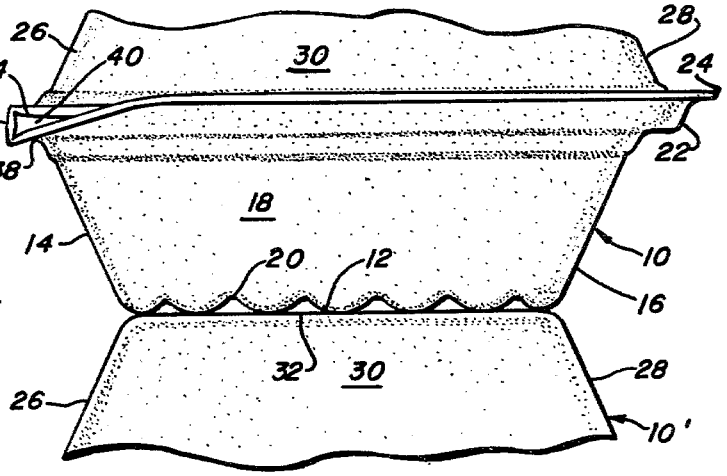
FIG. 2
FIG. 3
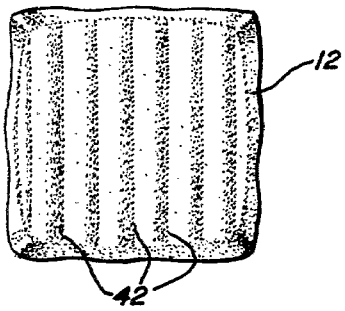
FIG. 4
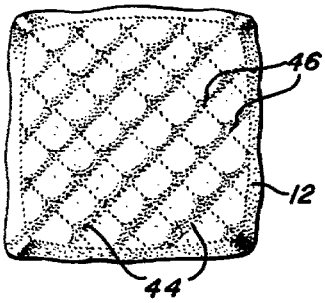
FIG. 5
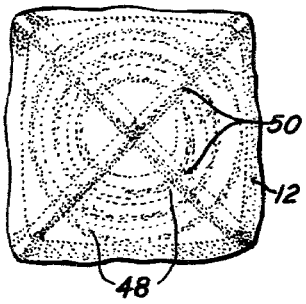
FIG. 6
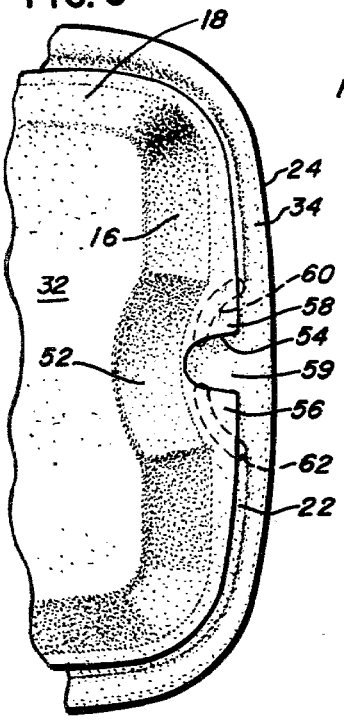
FIG. 7
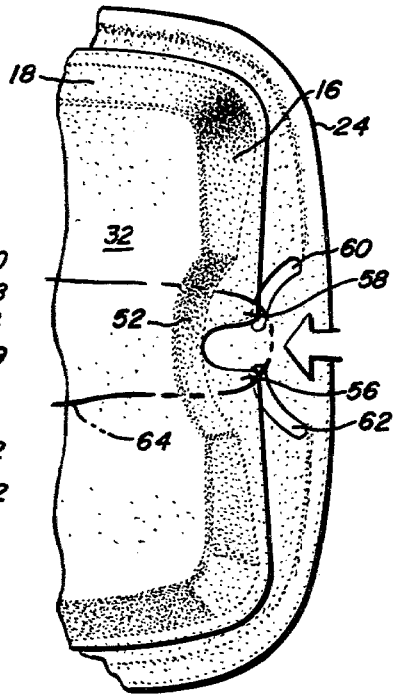
FIG. 8
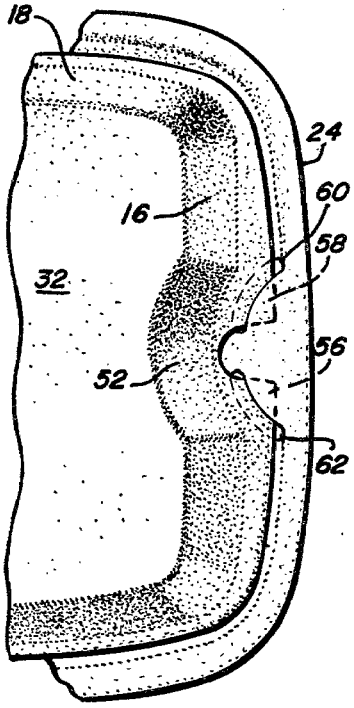

FAST FOOD CONTAINER

This is a division of Ser. No. 826,719 filed Aug. 22, 1977, now abandoned.

FIELD OF THE INVENTION

Deformable plastic containers made of foamed polystyrene and other materials are widely used in the food service field where containers are filled, stored, and supplied to the consumer at a later time. For the hot sandwich use, these are generally made in one piece having a common hinged border and a snap-in closure opposite said hinge.

DESCRIPTION OF THE PRIOR ART

Schubert et al. U.S. Pat. No. 3,935,962 (1976) discloses hot food containers similar to the container dislcosed herein and said patent is incorporated herein by reference, attention being particularly drawn to the container shown in FIG. 6 of said patent.

SUMMARY OF THE INVENTION

The object of my invention is to provide a new and useful container for a food product, such as a hamburger, having an improved latch.

Broadly, my invention resides in a deformable container comprising top and base members with outwardly sloping sidewalls hingedly attached along one wall and provided with latch means adapted to maintain said container closed. The latch means disclosed provides a secure closure, but one which is easily closed and opened. The latch includes a generally U-shaped cutout or notch on the lip providing two tabs extending outwardly from the top portion of the container which engage two slots in the sidewall of the lower portion. The slots are provided in the downwardly extending portion of a projection which extends inwardly from the tip of the lower portion and downwardly to the sloping sidewall. Due to the flexible nature of the container, pressure on the top or lid of the container permits deforming of the lid inwardly to permit insertion of and removal of the tabs from the slots.

BRIEF DESCRIPTION OF THE DRAWING

FIG. 1 illustrates three containers stacked one upon the other.

FIG. 2 shows a fragmentary side view of one container stacked upon another.

FIGS. 3, 4 and 5 show various bottom configurations.

FIGS. 6, 7 and 8 are fragmentary top views of the front portion of the container in the process of being closed, FIG. 6 before closure, and FIG. 8 showing the locked position.

DETAILED DESCRIPTION OF THE PREFERRED EMBODIMENTS

FIG. 1 illustrates three of the containers with the closure locked stacked one upon another, these being 10, 10' and 10''.

FIG. 2, a fragmentary side view of two of the stacked containers in greater detail. The top container 10 is shown resting upon the lower container 10'. Each container is provided with a lower portion having a base 12, upwardly sloping rear wall 14, front wall 16, and sidewalls 18. The bottom wall 12 is provided with a series of projections 20 adapted to maintain a food article positioned above the general level of the base 12 and to permit air circulation between said food article and said base. This also permits air circulation between containers. Near the upper portion of the bottom of the container there is provided an outwardly and upwardly shelf area 22 which terminates in lip 24. This shelf extends completely across the front almost completely along the sides. The top of container 10', shown in FIG. 2, contains a rear wall 26, front wall 28 and sidewalls 30. As shown in FIG. 1, the top 32 of the container is flat. Near the bottom of the top 30, there is an outwardly projecting lip 24 which rests in the shelf 22 of the bottom portion of the container. At the junction of the top portion and the bottom portion of the container, a hinge 36 is provided. The lip 24 on the bottom portion of the container extends downwardly to connect with hinge portion 36 as shown at 38, this resulting in a steam outlet space 40 between the top and bottom portions.

FIG. 3 shows a bottom plan view of the base 12 of container 10 provided with a series of grooves 42 extending across the bottom 12 of the container. Modifications are shown in FIGS. 4 and 5, FIG. 4 shows grooves 44 and 46 running diagonally between the sides of the container. FIG. 5 shows concentric circular grooves 48 and diagonal grooves 50 extending between corners of the bottom of the container. These projections permit circulation of air between the food product and the bottom, these configurations permit escape of steam present and reduce steam condensation in the food product.

FIGS. 6, 7 and 8 illustrate the features of the latch of my invention and show the container in the unlatched, in the process of being latched, and latched condition, respectively. Reference numerals similar to those set forth above are used in these figures. FIG. 6 illustrates the structure of front wall 16 which is provided with an inwardly protruded surface 52. The front portion of lip 34 on top of the container is provided surface 52. The front portion of lip 34 on top of the container is provided with a generally U-shaped cutout or notch 54 located in line with the inwardly protruded surface 52. As a result of this construction, tab portions 56 and 58 are formed. The front lip 24 on the bottom portion of the container has a shoulder 59 which extends inwardly from the lip 24 toward the hinge and downwardly to the shoulder portion 22. Two slots 60 and 62 are provided in the downwardly sloping wall of the projection 59 which are aligned with tabs 56 and 58. The wall portion between the slots strengthens shoulder 59.

In the process of closing the container, as shown in FIG. 7, the thumb or finger 64 of the operator is shown deforming the top front side wall so that tabs 56 and 58 are retracted sufficiently to drop into slots 60 and 62. The arrow indicates the direction of movement.

After depressing the top portion to its fully closed position such that lip 34 on the top portion contacts the shelf 22 on the lower portion, the pressure against inwardly protruding surface is removed and the tabs 56 and 58 extend into the slots 60 and 62 thereby extending under the lip 24 of the lower portion.

This results in a firmly locked package but one which is easily opened by the customer by pressing on the inwardly protruding surface 52 thereby unlatching the tabs from the slots. This constitutes an improvement over prior art locking systems which involve more complicated fastening systems or the use of longer slots which tend to weaken the article, and prevent a secure latch. The vertical portion of the member 59 in large measure produces this improvement and strengthens this portion of the container.

The improved structure disclosed herein is suitable for use within any container, but we believe it will find its greatest use in the insulated food package such as a hamburger container. Such products are made by thermoforming a foamed polystyrene sheet, but other plastic materials can be used.

While we have described a preferred embodiment of my invention, it will be obvious to those skilled in the art that additional modifications can be made while coming within the broad scope of my invention. For instance, latch means of the type described can be substituted for the hinge to produce a container latched on two sides as in FIG. 7 of Schubert et al. U.S. Pat. No. 3,935,962 supra.

I claim:

1. In a deformable container comprising top and base members, said base member having outwardly and upwardly sloping front side and rear walls and said top member having outwardly and downwardly sloping front side and rear walls, latch means adapted to form a secure closure between said top and base members, each said latch means comprising a lip on the outer end of a wall on one of said members, a shoulder having a downwardly extending sidewall projecting inwardly from said lip on said wall, two slots extending through the sidewall of said shoulder, and two tabs on the other of said members adapted to interlock with said slots.

2. A container especially adapted as a carry-out package for a hot sandwich comprising a base, front side and rear walls sloping upwardly and outwardly from said base, said front wall terminating in an outwardly extending lip, a cover having a top generally parallel to said base and front side and rear walls sloping downwardly and outwardly from said top, said front wall terminating in an outwardly extending lip, a hinge connecting said rear walls, a latch adapted to form a secure closure between said front walls, the first part of said latch comprising a shoulder having a downwardly extending sidewall projecting inwardly from the lip on the front wall extending from said base, two slots extending through the sidewall of said shoulder, and tabs on the lip of said top adapted to interlock with said slots.

3. A container including two mating portions capable of packaging a product therebetween in the closed position, one of the portions having an inwardly flexible side wall with a laterally outwardly directed locking tongue protruding from its closeable edge, the other portion having a skirt along its corresponding closeable edge which overlies the closeable edge of the one portion in the closed position, an inwardly directed recess in the skirt located in opposition to the locking tongue, the improvement comprising a pair of slots in the recess separated from each other by an interconnecting web and a notch bifurcating the locking tongue into two protruding sections whereby each bifurcated section of the tongue is inserted in one of the slots in the recess and the notch accommodates the web of the recess to lock the two portions together in the closed position, and the two portions of the container may be unlocked by flexing the side wall of the one portion inwardly to withdraw the tongue sections from the slots in the recess of the other portion to permit the container to be opened.

4. A container as in claim 3 wherein the inwardly directed recess in the skirt is formed by a pair of inwardly angled walls connected at their outer ends to the skirt and at their inner ends to a rear wall, the slots being located in the inwardly angled walls and the rear wall constituting the web.

5. A container as in claim 3 wherein the width of the notch at its base is only slightly greater than the width of the web which it accommodates in the closed position.

6. A container as in claim 3 wherein the effective width of the slots is only slightly greater than the width of the tongue sections inserted in them in the closed position.

7. A container as in claim 3 wherein the two mating portions are hingedly connected to each other so that the two portions may be rotated about the hinge into and out of the closed position.

8. A container as in claim 1 wherein each of the two mating portions is generally rectangular, and the skirt extends along one side and part of each adjacent side of the other portion, and in the closed position overlies the corresponding edge of the one portion and part of the edges of each adjacent side of the one portion.

9. A container as in claim 3 wherein each of the two mating portions are dish shaped with a base wall and surrounding side walls, the closeable edges of which are in mating engagement in the closed position.

10. A container as in claim 3 wherein the two mating portions are molded of inexpensive substantially uniform thickness material to form a container of the one-use-disposable variety for packaging a food product, each of the two mating portions are dish shaped with a base wall and surrounding side walls, the closeable edges of which are in mating engagement in the closed position, the one portion having the inwardly flexible side wall forms the top of the container and the other portion having the skirt forms the bottom of the container, the top and bottom are hingedly connected to each other so that they may be rotated about the hinge into and out of the closed position, the closeable edge of the inwardly flexible side wall of the top is defined by a laterally outwardly directed planar flange, containing the tongue sections and the skirt of the bottom forms a shoulder which supports the flange of the top in the closed position.

11. A container as in claim 10 wherein the inexpensive substantially uniform thickness material is foamed plastic.

* * * * *

UNITED STATES PATENT OFFICE

CERTIFICATE OF CORRECTION

Patent No. 4,253,600 Dated March 3, 1981

Inventor(s) Schubert, John C.

It is certified that error appears in the above-identified patent and that said Letters Patent are hereby corrected as shown below:

Patent

| Col. | Line | |
|---|---|---|
| 2 | 4 | after "upwardly" insert --extending-- |
| 2 | 11 | change "24" to --34-- |
| 4 | 26 | change "claim 1" to --claim 3-- |
| 4 | 50 | after "flange" delete --,-- |
| 4 | 51 | after "sections" insert --,-- |
| Fig. | 6-8 | change "16" to --28-- |
| Fig. | 6-8 | change "18" to --30-- |
| Fig. | 6 | extend lead line for 34 to lip on front wall 28 |

Signed and Sealed this

*Thirty-first* Day of *August 1982*

[SEAL]

*Attest:*

GERALD J. MOSSINGHOFF

*Attesting Officer* *Commissioner of Patents and Trademarks*